US005749490A

United States Patent [19]

Keicher

[11] Patent Number: 5,749,490

[45] Date of Patent: May 12, 1998

[54] DISPENSING BOTTLE HANGER

[75] Inventor: Roger Myron Keicher, Lancaster, N.Y.

[73] Assignee: RKR Advantage Inc., Lancaster, N.Y.

[21] Appl. No.: 473,522

[22] Filed: Jun. 7, 1995

Related U.S. Application Data

[63] Continuation-in-part of Ser. No. 187,174, Jan. 26, 1994.

[51] Int. Cl.[6] ..... B65D 25/28

[52] U.S. Cl. ..... 220/481; 220/483; 220/751; 220/754; 220/759; 215/399; 215/396

[58] Field of Search ..... 215/399, 395, 215/396; 220/483, 481, 480, 751, 741, 754, 759

[56] References Cited

U.S. PATENT DOCUMENTS

| | | | |
|---|---|---|---|
| 2,717,717 | 9/1955 | Busch | 220/483 |
| 3,073,493 | 1/1963 | Pfaffenberger | 220/759 |
| 3,299,442 | 1/1967 | White et al. | 4/110 |
| 3,366,360 | 1/1968 | Burke | 215/399 |
| 3,688,935 | 9/1972 | Owen et al. | 215/100 A |
| 3,693,923 | 9/1972 | Ayoub et al. | 248/360 |
| 3,768,684 | 10/1973 | Buchtel | 215/100 R |
| 3,807,679 | 4/1974 | Burke et al. | 248/359 |
| 3,908,952 | 9/1975 | Von Alven | 215/399 |
| 4,306,662 | 12/1981 | Sciortino et al. | 215/100 A |
| 4,460,143 | 7/1984 | Ohama | 248/359 |
| 4,627,546 | 12/1986 | Carranza | 215/396 |
| 4,678,102 | 7/1987 | Ryder | 222/181 |
| 4,724,971 | 2/1988 | Henline | 215/396 |
| 4,842,158 | 6/1989 | Reyes, Jr. | 215/396 |
| 4,896,913 | 1/1990 | Kennedy | 215/396 |

FOREIGN PATENT DOCUMENTS

| | | | |
|---|---|---|---|
| 216410 | 7/1961 | Austria | 220/483 |

*Primary Examiner*—Stephen J. Castellano
*Attorney, Agent, or Firm*—Hodgson, Russ, Andrews, Woods & Goodyear LLP

[57] ABSTRACT

An inexpensive hanger for a shampoo or other material dispensing bottle. The hanger comprises a thin web of material which preferably has one opening permitting it to be securely attached between the cap and body of the bottle with the neck received in the opening and another opening for hanging it on a hook on a wall. The web of material is selected to have sufficient rigidity or stiffness to allow the bottle to be hung with only one hand (which holds the body of the bottle) and to have sufficient flexibility to allow it to be deformed to lie alongside the bottle so that the hanger may be marketed attached to the bottle without the necessity of changing existing packaging for the bottle. The web alternatively has at one end an opening sized to receive the body of the bottle and at the other end an opening, preferably two openings of different sizes, to receive the bottle neck so that the bottle may be hung upside down.

10 Claims, 2 Drawing Sheets

DISPENSING BOTTLE HANGER

This application is a continuation-in-part of co-pending patent application Ser. No. 08/187,174, filed Jan. 26, 1994, the disclosure of which is incorporated herein by reference.

The present invention relates generally to hangers for dispensing bottles such as shampoo bottles. Various hangers for bottles are disclosed in U.S. Pat. Nos. 3,299,442; 3,688,935; 3,693,923; 3,768,684; 3,807,679; 4,306,662; 4,460,143; and 4,678,102.

U.S. Pat. No. 3,299,442 to White et al discloses a hospital bottle for receiving drains which has a strap, illustrated at 14 therein, which may be used for suspending the bottle from a bed rail as well as serving as a handle for carrying the bottle from one location to another. In order to take the weight off of the suspension strap when removing the bottle from a bed rail, a separate handle, illustrated at 24 therein, is provided. The handle is formed of a flat sheet of latex material and has a finger opening, illustrated at 29 therein. The handle is adapted to fit onto the neck of the bottle by placing an opening thereof over the neck to underlie lugs, illustrated at 26 therein. The handle may be flexed from a position lying alongside the upper surface of the bottle to an upstanding position during holding by a person for carrying of the bottle about.

Shampoo bottles typically have a screw-on cap with a closable dispensing aperture in the end of the cap so that the cap need not be removed in order to dispense shampoo.

Space is usually at a premium in barber and beauty shops such that it may be desirable to hang shampoo and other liquid dispensing bottles on a wall. However, the nature of a hairstylist's work is such that both hands may not be conveniently free to hang a bottle after use or to remove it for use, and it may be necessary to hang and remove a bottle many times during a day's work. Space is also at a premium in showers in private homes such that it may also be desirable to conveniently and easily hang shampoo bottles on the shower walls.

The hanger should desirably be inexpensive and attachable to a bottle so that the bottle may still be packaged without changing the packaging so that it may be easily marketable. The hanger desirably should be removable so that it can be easily marketed separately and easily yet securely attachable to a bottle by a customer for use. The above-identified patents do not teach or suggest a hanger for a dispensing bottle which fulfills the above requirements.

Accordingly, it is an object of the present invention to provide an inexpensive hanger which is easily yet securely attachable to a dispensing bottle so that it may be easily hung on a wall.

It is another object of the present invention to provide such a hanger which allows the bottle to be easily hung by the use of only one hand holding the bottle whereby a hairdresser's other hand may do other tasks while the bottle is being hung.

It is a further object of the present invention to provide such a hanger which may be marketed attached to a bottle such that existing packaging for the bottle need not be changed.

It is yet another object of the present invention to provide such a hanger which may be used for more than one bottle size so that the number of different sizes of hangers may be reduced.

It is a still further object of the present invention to afford a means for easily hanging the bottle upside down for dispensing convenience.

In accordance with the present invention, a dispensing bottle hanger comprises a single-piece web of material preferably having an opening in which the neck of the bottle is received, the hanger being secured to the bottle by screwing the cap thereon. Thus, the hanger may be marketed separately for attachment easily by the customer or attached to the bottle ready for use. The web has a flexibility to be deformable to lie alongside the bottle so that the bottle with the hanger attached may be accommodated in existing packaging for the bottle without the hanger. The web has a stiffness to allow hanging of the bottle by a person with the person holding the bottle with one hand but without the person having to hold the hanger with the other hand.

Also in accordance with the present invention, a dispensing bottle hanger comprises a single-piece web of material which has a first opening on one end portion sized to receive the body of the bottle and a second opening, preferably a pair of second openings having different sizes, on the other end portion for receiving the bottle neck. The central portion of the web is attachable to a wall so that the bottle can hang suspended upside down from the hanger.

The above and other objects, features, and advantages of the present invention will be apparent in the following detailed description of the preferred embodiment thereof when taken in conjunction with the accompanying drawings wherein the same reference numerals denote the same or similar parts throughout the several views.

DETAILED DESCRIPTION OF THE PREFERRED EMBODIMENT

Figure 1:
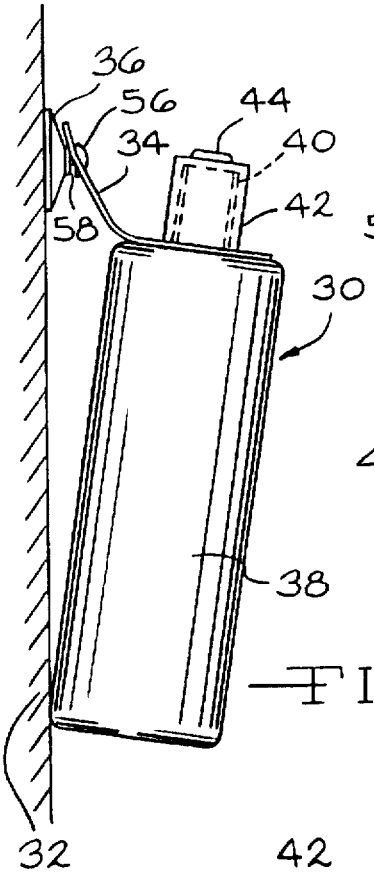
FIG. 1 is a side view of a bottle and hanger in accordance with the present invention with the bottle shown hanging on a wall.
Figure 2:
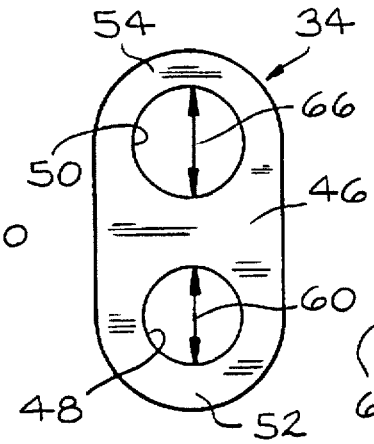
FIG. 2 is a plan view of the hanger.
Figure 3:
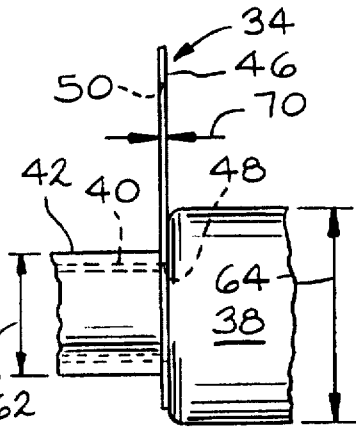
FIG. 3 is a side or edge view thereof and illustrating its attachment to the bottle.

Referring to FIGS. 1 to 3, there is shown generally at 30 a conventional bottle for dispensing shampoo or other material, the bottle shown hanging on a wall, illustrated at 32, of perhaps a barber shop or beauty parlor or of a shower in a private home thus allowing a more efficient use of space therein. The bottle 30 is hung by means of hanger 34 and a conventional suction cup 36 which is attachable to the wall 32 as commonly known in the art.

The bottle 30 includes a body portion 38 having at one end (the dispensing end) a threaded neck 40 upon which cap 42 may be screwed. The end of the cap 42 has a closable opening 44 for normal dispensing of shampoo or other material from the bottle 30, which allows the cap 42 to be normally kept secured on the neck 40. Such a bottle is conventional in the art.

The hanger 34 comprises a thin web 46 of suitable material, preferably a strong and flexible material such as, for example, polyethylene which accordingly doesn't get brittle and break and which is also inexpensive. The web 46 has a pair of apertures or circular openings 48 and 50 in its end portions 52 and 54 respectively.

Web end portion 52 is attached to the upper end (liquid dispensing end) of the bottle 30, and the end portion 54 is hung on the suction cup 36 by means of a portion 56 of suction cup 36 (opposite the wall-engaging surface) being received in the opening 50 with the edge of the opening engaging a circumferential groove 58 in suction cup portion 56. The opening 50 is oversized relative to portion 56 to permit the groove 58 to be readily engaged by the edge of the opening 50. It should be understood that the present invention is not limited to the hanger being hung on a suction cup, but it may be hung on various other types of hooks.

Opening 48 is sized to receive the neck 40 but its diameter, illustrated at 60, is less than the diameter, illustrated at 62, of the cap 42 as well as the diameter, illustrated at 64, of the body 38 of the bottle so that the web 46 is securely yet easily replaceably held between the cap 42 and body 38 of the bottle when the cap 42 is securely screwed thereon, the cap normally remaining secured on the bottle and shampoo being dispensed through closable opening 44.

Many shampoo bottles are of a standard size for which opening 48 has a suitable diameter. Others may be of a larger size requiring a larger diameter. For attachment of the hanger 34 to those other bottles, opening 50 is provided with a larger diameter, illustrated at 66. Thus, either of the end portions 52 and 54 may be attached to a bottle, depending on its size, and the other may then be hung on hook 56. Thus, the openings 48 and 50 are preferably provided to have different diameters so that the same hanger may fit a greater number of shampoo bottles.

Figure 4:
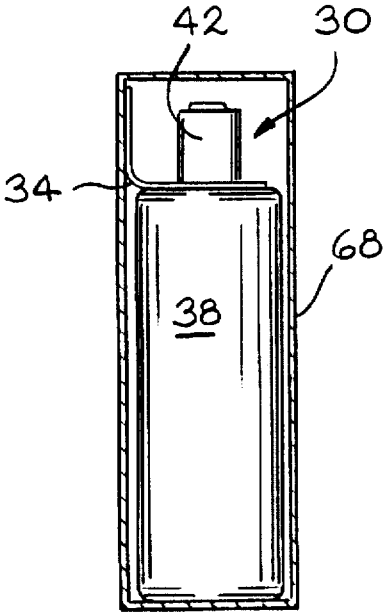
FIG. 4 is a side view, partly in section, of the bottle shown packaged.

In order that the hanger 34 may be marketed attached to a bottle 30 without the necessity of changing existing packaging to accommodate the hanger, in accordance with the present invention the web 46 has a flexibility to be deformable to lie alongside the cap, as illustrated in FIG. 4 or otherwise alongside the bottle. Thus, as shown in FIG. 4, the packaging 68, shown in section, is sized so as to receive the bottle without the hanger, and it need not be changed to also accommodate the hanger.

A hairdresser may be busy with one hand doing something else while removing or replacing a shampoo bottle with the other hand. In order to hang a shampoo bottle with one hand, in accordance with the present invention the web 46 has a stiffness to allow the bottle to be hung while holding just the bottle and without the need to hold the hanger 34 with the other hand.

The thickness, illustrated at 70, of the web 46 is selected to provide the desired stiffness to hang the bottle without holding the hanger while at the same time providing the desired flexibility so that it may be packaged attached to a bottle without the necessity of changing existing packaging. As the thickness 70 decreases, the web may tend to become floppy, requiring two hands for hanging a bottle. As the thickness 70 increases, the web may tend to become stiffer so that it doesn't flex as easily for accommodation in existing packaging. For polyethylene as the web material, a thickness 70 of about 0.03 inch has been determined to provide a suitable stiffness as well as a suitable flexibility. The thickness 70 which achieves both a suitable stiffness and a suitable flexibility may of course vary depending on the material of which the hanger is composed.

In order that the hanger 34 may be attached to most shampoo bottles, the diameters 60 and 66 may perhaps be about ⅞ inch and 1 3/16 inch respectively. End portion 52 may thus be attachable to a bottle which has a neck having an outer diameter of perhaps about 13/16 inch, a cap having an outer diameter of perhaps about 1¼ inch, the body of the bottle having a diameter or dimension greater than that of the cap. The web 46 may have a length of perhaps about 3 inches and a width of perhaps about 1½ inch.

Figure 5:
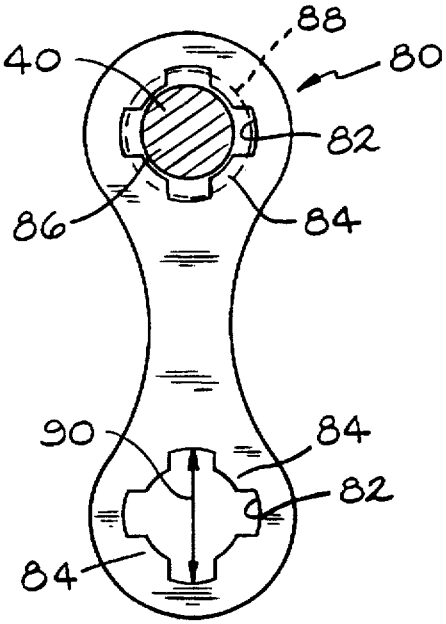
FIG. 5 is a plan view of an alternative embodiment of the hanger.

Referring to FIG. 5, there is illustrated at 80 a hanger in accordance with an alternative embodiment of the present invention. As shown in FIG. 5, the hanger 80 may have an increased length of perhaps about 4 inches whereby the increased length would perhaps require the web to be deformed to lie alongside the body 38. Hanger 80 may have a thickness similar to that of hanger 34 and is shown to have a decreased width centrally thereof. The hanger 80 is shown to have two openings 82 which may be described as scalloped, i.e., each opening may be described as circular with a plurality of perhaps four circumferentially-spaced tabs 84 extending inwardly, when the neck of a bottle is received in the opening 82, substantially to an unthreaded portion 86 of the neck 40 and having flexibility to allow the tabs 84 to be flexed to get by the threads of the threaded portion 88 of the neck 40 for receiving the neck in the opening 82. After the hanger 80 is inserted beyond the threaded portion 88 to the unthreaded portion 86, the tabs 84 will act to resist removal of the hanger 80 from the neck 40 when the cap 42 is removed. The opening 82 is defined to have a diameter illustrated at 90. While openings 82 are shown to have the same diameter 90, it should be understood that they may have different sizes.

Thus, there is provided in accordance with the present invention an inexpensive removable hanger for a shampoo bottle or the like which may be securely yet easily attached to the bottle and easily hung with only one hand (the hanger having rigidity so that it need not also be held while the bottle is being held for hanging the bottle) yet has flexibility to be deformed to lie alongside the bottle so that it may be marketed attached to the bottle without the necessity of changing existing packaging. As apparent from FIGS. 2 and 5, the hanger may be provided in various shapes and sizes which come within the scope of the present invention. The dispensing bottle may also be provided in various shapes and sizes and dispense various liquids and other materials. For example, the bottle may be a tube of toothpaste.

Figure 6:
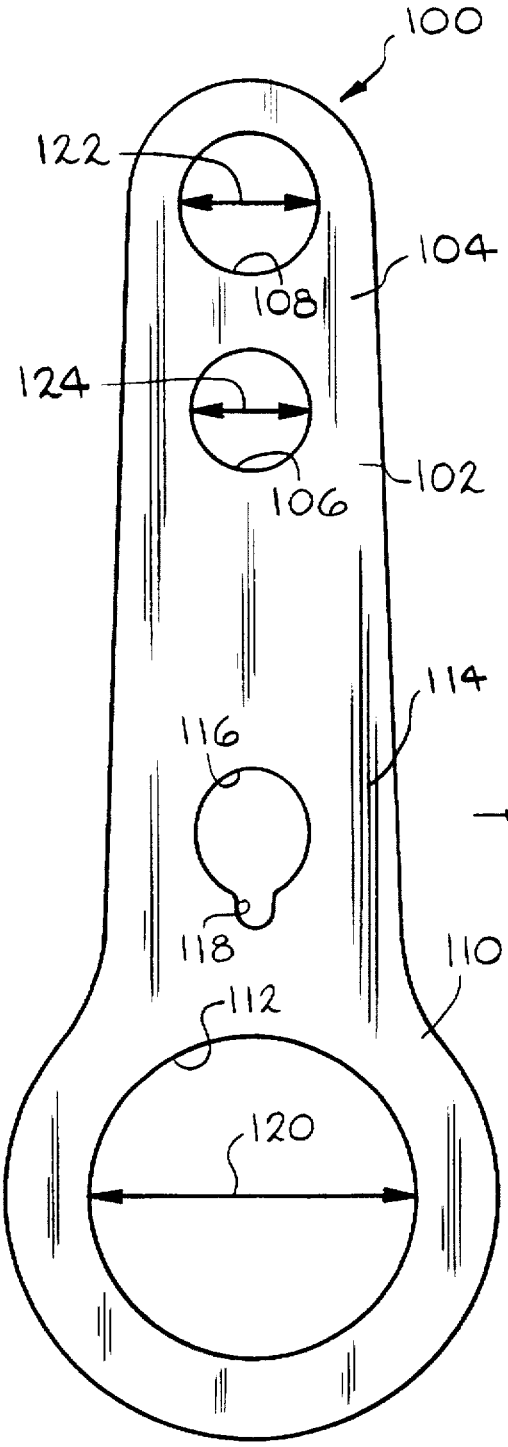
FIG. 6 is a plan view of a hanger for a bottle to hang upside down in accordance with the present invention.
Figure 7:
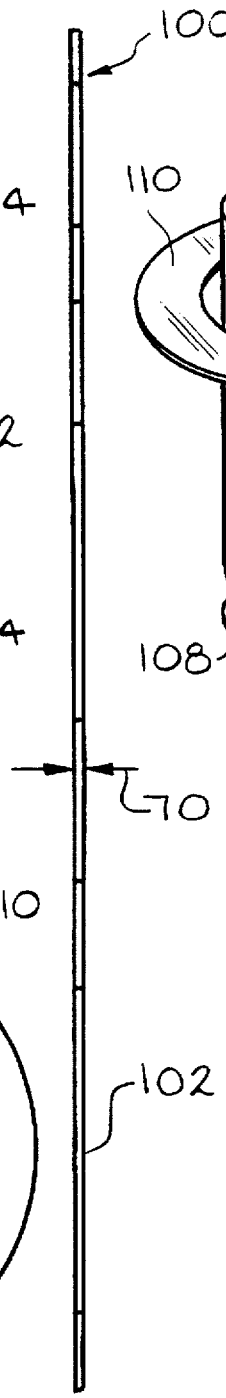
FIG. 7 is a side edge view thereof.

Referring to FIGS. 6 and 7, there is shown generally at 100 a hanger in accordance with an alternative embodiment of the present invention. Hanger 100 comprises a thin single-piece elongate web 102 of material which is similar to the material of which web 46 is composed and has thickness 70.

Figure 8:
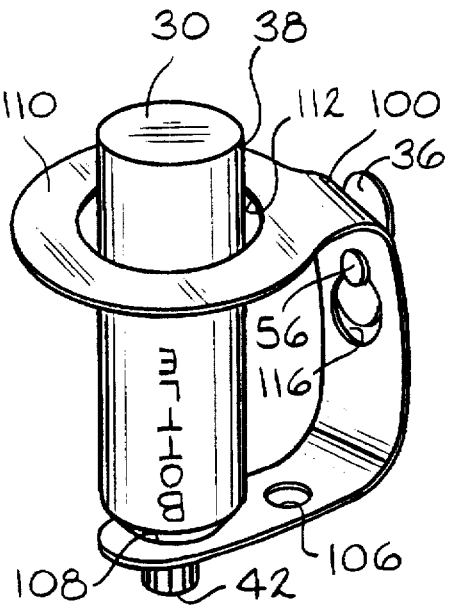
FIG. 8 is a perspective view of the hanger of FIG. 6 attached to a bottle so that the bottle hangs upside down.

Similarly as shown for web 46, web 102 has in one end portion 104 a pair of longitudinally spaced apertures 106 and 108 of different sizes for different size bottle necks 40. As seen in FIG. 8, one of these apertures 108 receives the bottle neck 40, and the cap 42 is screwed on to secure the web 102 thereto, the apertures 106 and 108 being sized not to receive the cap 42. It should of course be understood that the web 102 may, if desired, be provided with only one of the first apertures 106 and 108.

Web 102 has in its other end portion 110 another aperture, illustrated at 112, sized for receiving the body portion 38 of the bottle 30.

Web 102 also has in its longitudinally central portion 114 a third aperture 116 having a notch, illustrated at 118, which faces the end portion 110, for receiving portion 56 of suction cup 36.

As seen in FIG. 8, the bottle 30 is hung upside down by means of the notch 118 of third aperture 116 receiving suction up portion 56 with the end portion 104 attached to the bottle neck 40 and with the aperture 112 receiving the bottle body 38. The bottle 30 may be easily and conveniently removed from suction cup 36 for dispensing and easily and conveniently replaced. If desired, the closable opening 44 may be opened and shampoo dispensed without removal of the bottle 30 from the suction cup 36.

The web length and locations of apertures are desirably chosen so that, as seen in FIG. 8, the end portion 110 engages the bottle body 38 near the bottom thereof, i.e., perhaps in about the lower quarter of the body length, to provide stability to the hanging of the bottle.

One typical shampoo dispensing bottle may have a body length of about 7 inches, a body diameter of about 2½ inches, and a neck diameter of about ⅞ inch. Another typical shampoo dispensing bottle may have a body length of about 5¼ inches, a body diameter of about 2 inches, and a neck diameter of about ⅞ inch. The aperture 112 has a diameter, illustrated at 120, which is at least about 2 inches and is preferably about 2½ inches to accommodate both of the above typical body diameters. Aperture 116 may have a diameter of, for example, perhaps about ⅞ inch.

Larger size dispensing bottles may typically have greater lengths as well as larger diameter necks. Aperture 108 has a larger diameter, illustrated at 122, which may perhaps be about 1 inch and is spaced a greater distance, such as perhaps about 5¾ inches, from aperture 112 to stably accommodate larger size bottles. Aperture 106, which is longitudinally inward of aperture 108, has a smaller diameter, illustrated at 124, which may perhaps be about ⅞ inch and is spaced a lesser distance, such as perhaps about 4¼ inches, from aperture 112 to suitably accommodate smaller size bottles. Diameters 106 and 108 should of course be less than the outer diameter of the respective bottle cap 42. The notch 118 of aperture 116 may be located a distance of perhaps about ¾ inch from aperture 112 in order to suitably position apertures 112 and 106 and 108 for suitable hanging of the bottle. The overall web length may perhaps be about 10 inches.

It should be understood that the openings 106, 108, 112, and 116 may be otherwise suitably shaped, such as, for example, illustrated in FIG. 5, and such other opening shapes are meant to come within the present invention as defined in the appended claims.

It should be understood that, while the invention has been described in detail herein, the invention can be embodied otherwise without departing from the principles thereof, and such other embodiments are meant to come within the scope of the present invention as defined by the appended claims.

What is claimed is:

1. In combination with a dispensing bottle having an elongate body portion for containing a material, a neck portion defining an opening to said body portion, and a cap removably attachable to said neck portion for closing said opening, a hanger for hanging said bottle, said hanger comprising a single-piece elongate web of material having a pair of end portions and a central portion between said end portions, means defining at least one first opening in one of said end portions of said web which said means defining the first opening is sized to receive said body portion, means defining at least one second opening in the other of said end portions of said web which said means defining the second opening is sized to receive said neck and to be held between said bottle body and said cap, and said central portion having means for removably attaching said web to a wall to support said bottle upside down for dispensing.

2. A combination according to claim 1 wherein said bottle is a shampoo bottle.

3. A combination according to claim 1 wherein said means for attaching said web to a wall comprises means defining a third opening in said central portion of said web and a suction cup attachable to a wall and having a hook means insertable in said means defining the third opening for hanging said web.

4. A hanger for a shampoo bottle having an elongate body portion for containing shampoo, a neck portion defining an opening to the body portion, and a cap removably attachable to the neck portion for closing the opening, the hanger comprising a single-piece elongate web of material having a pair of end portions and a central portion between said end portions, means defining at least one first opening in one of said end portions of said web which means defining the first opening is sized to receive a shampoo bottle body portion, means defining at least one second opening in the other of said end portions of said web which means defining the second opening is sized to receive a neck portion of a shampoo bottle and not to receive the cap therefor whereby said web is securable to said shampoo bottle by receiving the neck portion of a shampoo bottle in the second opening and attaching the cap with said web thereby being held between the bottle body and the cap, and said central portion having means for removably attaching said web to a wall to support said bottle upside down for dispensing.

5. A hanger according to claim 4 wherein said web is composed of polyethylene having a thickness of about 0.03 inch.

6. A hanger according to claim 4 wherein said means for removably attaching said web to a wall comprises means defining a third opening which is between said at least one first opening and said at least one second opening.

7. In combination with a dispensing bottle having an elongate body portion for containing a material, a neck portion defining an opening to said body portion, and a cap removably attachable to said neck portion for closing said opening, a hanger for hanging said bottle, said hanger comprising a single-piece elongate web of material having a pair of end portions and a central portion between said end portions, means defining at least one first opening in one of said end portions of said web which said means defining the first opening is sized to receive said body portion, means defining at least one second opening in the other of said end portions of said web which means defining the second opening is sized to receive said neck and to be held between said bottle body and said cap, said central portion having means for removably attaching said web to a wall, and said means defining the second opening comprising means defining two openings of different sizes for different bottle neck sizes.

8. A hanger for a shampoo bottle having an elongate body portion for containing shampoo, a neck portion defining an opening to the body portion, and a cap removably attachable to the neck portion for closing the opening, the hanger comprising a single-piece elongate web of material having a pair of end portions and a central portion between said end portions, means defining at least one first opening in one of said end portions of said web which means defining the first opening is sized to receive a shampoo bottle body portion, means defining at least one second opening in the other of said end portions of said web which means defining the second opening is sized to receive a neck portion of a shampoo bottle and not to receive the cap therefor whereby said web is securable to said shampoo bottle by receiving the neck portion of a shampoo bottle in the second opening and attaching the cap with said web thereby being held between the bottle body and the cap, said central portion having means for removably attaching said web to a wall, and said means defining the second opening comprising means defining two openings of different sizes for different bottle neck sizes.

9. A hanger according to claim 8 wherein a smaller of said two openings is disposed longitudinally inwardly of a larger of said two openings.

10. A hanger according to claim 9 wherein said first opening has a diameter which is about 2½ inches, and said second openings have diameters of about ⅞ inch and 1 inch respectively.

* * * * *